US005618385A

United States Patent [19]

Jones et al.

[11] Patent Number: 5,618,385

[45] Date of Patent: Apr. 8, 1997

[54] METHOD OF PEROXIDE BLEACHING OF PULP USING A PEROXIDE DECOMPOSING INACTIVATOR

[75] Inventors: Trevor E. Jones, Halesowen; Stephen Crelling, Droitwich; Robert E. Talbot, Cannock, all of England

[73] Assignee: Albright & Wilson Limited, Warley, England

[21] Appl. No.: 331,335

[22] Filed: Oct. 28, 1994

Related U.S. Application Data

[63] Continuation of Ser. No. 36,485, Mar. 24, 1993, abandoned.

[30] Foreign Application Priority Data

Mar. 24, 1992 [GB] United Kingdom ..... 9206415

[51] Int. Cl.[6] ..... D21C 9/16

[52] U.S. Cl. ..... 162/6; 162/65; 162/70; 162/87; 162/78

[58] Field of Search ..... 162/65, 6, 66, 162/67, 88, 89, 78, 87, 29; 8/111

[56] References Cited

U.S. PATENT DOCUMENTS

| | | | |
|---|---|---|---|
| 2,358,866 | 9/1944 | MacMahon | 162/78 |
| 3,663,357 | 5/1972 | Liebergott et al. | 162/65 |
| 3,817,828 | 6/1974 | Bendiner | 162/161 |
| 3,865,685 | 2/1975 | Hebbel et al. | 162/78 |
| 4,053,352 | 10/1977 | Hultman et al. | 162/29 |

FOREIGN PATENT DOCUMENTS

| | | |
|---|---|---|
| 141138A1 | 5/1985 | European Pat. Off. . |
| 209073 | 4/1924 | United Kingdom . |
| 974073 | 11/1964 | United Kingdom . |

*Primary Examiner*—Steven Alvo

*Attorney, Agent, or Firm*—Frishauf, Holtz, Goodman, Langer & Chick, P.C.

[57] ABSTRACT

Chlorine dioxide is used to stabilize hydrogen peroxide in bleach liquor at alkaline pH. This is thought to be aided by the destruction of enzymes (especially catalase) produced by bacteria. The method is useful for the reprocessing of pulps, especially when a de-inking stage is involved.

20 Claims, No Drawings

METHOD OF PEROXIDE BLEACHING OF PULP USING A PEROXIDE DECOMPOSING INACTIVATOR

This application is a Continuation of application Ser. No. 08/036,485, filed Mar. 24, 1993, now abandoned.

The present Invention relates to a novel method of stabilizing bleaching liquors containing an enzyme-sensitive bleach and at least one enzyme which catalyzes the decomposition of the bleach. A typical example of an enzyme sensitive bleach is hydrogen peroxide.

Hydrogen peroxide is an effective bleaching or brightening agent conventionally used in the bleaching of inter alia, fibres, fabrics and food products, minerals and inorganic products e.g. recycled cellulose—containing pulp.

Bleaching and recycle liquors and/or cellulose—containing pulps often contain bacteria which produce enzymes such as catalase, catalyzing the decomposition of hydrogen peroxide. The problem is offset by adding an excess of hydrogen peroxide to the system to achieve an improvement in brightness. Clearly, a significant reduction in the rate of decomposition would render the process more economical and/or further improve brightness.

It has been proposed that the decomposition of the peroxide may be reduced by heating the process liquor to approximately 70° C. (to destroy bacteria and catalase), but this has been found to be uneconomic on a large scale. Biocides which can kill the bacteria generally do not inactivate the enzymes.

It is known to use chlorine, chlorine dioxide and ozone as bleaches. These compounds are typically either more expensive or less environmentally acceptable than hydrogen peroxide, but are more stable and are substantially more effective in some applications than hydrogen peroxide. They thus occupy different niches from hydrogen peroxide in the bleach market.

We have now discovered that chlorine dioxide, chlorine, bromine, iodine and ozone, even in very low concentrations, e.g. substantially less than would be required for effective bleaching, can both kill the bacteria which generate bleach-decomposing enzymes and inactivate the enzymes themselves.

The present invention provides the use of an enzyme—inactivating amount of at least one enzyme-inactivator selected from chlorine, bromine, iodine, chlorine dioxide and ozone to stabilize bleaching liquors containing an enzyme—sensitive bleach and an enzyme which, the absence of said enzyme—inactivator, catalyzes the decomposition of said bleach.

According to a further embodiment the invention provides a method of bleaching which comprises contacting a bleachable material with at least one enzyme-sensitive bleach, wherein said bleach is contacted with liquors containing at least one enzyme which when active, catalyzes the decomposition of said bleach and wherein said liquors are contacted with an enzyme-inactivating amount of an enzyme-inactivator selected from the group consisting of chlorine, bromine, iodine, chlorine dioxide and ozone.

Whilst the invention is described hereinafter with particular reference to the hydrogen peroxide bleaching of reprocessed paper and similar pulps, it is not to be construed as being limited thereto; the bleaches can be used in the bleaching of cellulosic and mechanical pulps, namely wood, bagasse, flax and fibre, or recycled pulps. Moreover, the bleaches can be applied to protein fibres, for example keratin, or to minerals such as kaolin and to inorganic industrial products. Alternatively, the bleachable material may be in the form of a food product such as rice, flour, fish and derivatives, thereof. The bleach may be any enzyme-sensitive bleach such as perborate, percarbonate or percarboxylates.

For commercial, technical and environmental purposes, enzyme-sensitive bleaches, such as hydrogen peroxide are strongly preferred as bleaches for certain types of applications. Our invention is primarily concerned with processes in which the bleaching of the bleachable material is effected to a substantial degree by the enzyme-sensitive bleach. Our work concerns the discovery that the enzyme-inactivators appear to render the destabilizing enzymes inactive and destroy the offending bacteria.

Chlorine dioxide is the preferred enzyme—inactivator on grounds of effectiveness and environmental acceptability. The invention is particularly applicable to the bleaching of cellulose pulp and especially repulped newsprint and similar recycled cellulose. Typically, waste paper is pulped in an aqueous medium comprising alkali (e.g. caustic soda), peroxide stabliser (e.g. sodium silicate) and hydrogen peroxide. A liquor is separated from the finished pulp, usually diluted with any make-up water required and recycled to the pulper.

The enzyme inactivator may be introduced into the liquor at various points in the process, but is especially useful when introduced into the diluted recycle liquor. Very low concentrations of enzyme-lnactivator in the recycled liquor are sufficient in eliciting enzyme-inactivation, typically between 0.01 and 500 ppm, usually 5 ppm to 300 ppm especially 10 ppm 200 ppm, preferably 20 to 100 ppm based or the weight of liquor.

On economic grounds we prefer not to use substantially more enzyme-inactivator then the minimum required to inactivate the enzymes present. These quantities are typically not sufficient to effect bleaching of the bleachable material. We prefer not to use quantities of the inactivator sufficient to effect bleaching of the bleachable material to any substantial extent.

In general we prefer that sufficient enzyme-sensitive bleach such as hydrogen peroxide is used substantially to bleach the bleachable material. For example we prefer that the hydrogen peroxide is at least sufficient, e.g. in excess of the amount required, to bleach all the peroxide-bleachable compounds present. However in some instances the final product specification does not require total bleaching. In those instances it is preferred that the amount of hydrogen peroxide is sufficient to achieve the desired level of bleaching.

Suitably the bleachable material is contacted with a bleach liquor which may contain from 0.05 to 8% of an enzyme-sensitive bleach, such as hydrogen peroxide, by volume based on the volume of bleach liquor, typically 0.01 to 4%, e.g. 0.03 to 0.15%. Alternatively, the bleach liquor may contain about 0.05% to 80% enzyme-sensitive bleach by weight relative to the total weight of solid to be bleached, typically 0.1 to 50% especially 0.5% to 1%.

Typically, the bleach liquor may contain about 1% hydrogen peroxide by weight relative to the total weight of material to be bleached.

We prefer in a typical bleaching process to use from 0.05 to 5% of bleach-inactivator by weight based on the weight of enzyme-sensitive bleach e.g. 0.1 to 2% especially 0.5 to 1.5% most preferably 0.1 to 1%

Bleaching and brightening with hydrogen peroxide is usually carried out under alkaline conditions and the preferred pH of the bleaching/brightening stage is from 5 to 14 preferably 7 to 12 e.g. 8 to 11.5.

Suitably the bleaching is affected at a pH greater than 10. Alternatively, the bleaching is effected at a pH greater than 5. Preferably, the bleaching is affected at a pH greater than 8.

The present invention will be illustrated, merely by way of example, as follows.

EXAMPLES 1 and 2

Backwater (recycled water) from a paper machine and the de-inking sections of a paper recycling plant is collected in a filtrate head tank prior to re-use in the pulping stage. Samples of cold water from the filtrate head tank were used.

The following solutions were prepared:

| TEST SOLN | FHTW(1) (ml) | $ClO_2$ solution(2) (ml) | $H_2O_2$ solution(3) (ml) | Distilled water (ml) |
|---|---|---|---|---|
| (a) | 70 | 20 (= 88 ppm) | 10 | 0 |
| (b) | 70 | 15 (= 66 ppm) | 10 | 5 |
| (c) | 70 | 10 (= 44 ppm) | 10 | 10 |
| (d) | 70 | 5 (= 22 ppm) | 10 | 15 |

Notes
(1)Water from filtrate head tank
(2)Chlorine dioxide stock solution (440 ppm). Quantities in brackets show parts per million of chlorine dioxide.
(3)Stock solution of hydrogen peroxide in distilled water (approx. 10 g/l).

The peroxide was added to each test solution last. Each solution was mixed thoroughly by shaking. The peroxide concentration in each solution will be approximately 1 g/l, to approximately 1000 ppm.

The peroxide decomposition rate was studied as follows:

1. Take 10 ml aliquot of test solution.
2. Quench 1. in approx 2 mls 50% acetic acid (to acidify).
3. Add about 15 ml 10% potassium iodide solution (to liberate iodine).
4. Add 2–3 drops of 10% ammonium molybdate solution.
5. Titrate with 0.1N sodium thiosulphate solution to a colourless end-point (using starch solution near the end-point).

According to this method 1 ml O.IN $Na_2S_2O_3$=0.0017 gms $H_2O_2$ $H_2O_2$ present in aliquot=(titre×0.0017) gms $H_2O_2$ present in test solution=(titre×0.017) gms $H_2O_2$ concentration in test solution = (titre × 0.17) gms/liter
= (titre × 0.17 × 1000) ppm

EXAMPLE 1 RESULTS

| Test Solution | $ClO_2$ Content ppm | ppm $H_2O_2$ Remaining after: 2 minutes | 12 minutes |
|---|---|---|---|
| (a) | 88 | 1182 | 1190 |
| (b) | 66 | 1165 | 1105 |
| (c) | 44 | 442 | ND |
| (d) | 22 | 391 | ND |

Note
$ClO_2$ content is also analysed by the method above. 'Unused' $ClO_2$ in the test solution, would therefore give a positive titration. The titre due to 'unused' $ClO_2$, was negligible compared to the titre due to $H_2O_2$.

Normally, in the absence of an enzyme inactivator the hydrogen peroxide would be expected to decompose entirely under the conditions of this experiment.

EXAMPLE 2

The method of Example 1 was repeated on a sample of cold filtrate head tank water taken the previous day (this being normally less active with respect to bacteria and/or catalase).

The test solutions were made up as follows:

| TEST SOLN | FHTW(1) (ml) | $ClO_2$ solution(2) (ml) | $H_2O_2$ solution(3) (ml) | Distilled water (ml) |
|---|---|---|---|---|
| (a) | 70 | 0 | 10 | 20 |
| (b) | 70 | 20 (= 88 ppm) | 10 | 0 |

Notes
(1)Filtrate head tank water.
(2)Chlorine dioxide solution. (440 ppm)
(3)Peroxide concentration 10 g/l.

EXAMPLE 2 RESULTS

| Test Solution | $ClO_2$ Content ppm | ppm $H_2O_2$ Remaining after: 2 mins | 7 mins | 12 mins | 30 mins | 45 mins |
|---|---|---|---|---|---|---|
| (a) | 0 | 782 | 340 | 136 | — | — |
| (b) | 88 | 1224 | 1190 | 1165 | 1148 | 1131 |

The peroxide stock solution itself when analysed separately was found to contain 11560 ppm $H_2O_2$.

EXAMPLE 3

An experiment was conducted to assess the bactericidal effect of chlorine dioxide in backwater. This was achieved by adding chlorine dioxide, at various dose rates, to backwater and shaking to mix. After an exposure time of 10 seconds, the bacterial levels were enumerated by means of dipslides. As a control, an untreated sample of backwater was enumerated.

EXAMPLE 3 RESULTS

| CHLORINE DIOXIDE DOSE (PPM) | BACTERIAL LEVEL (CFU/ML) Aerobic | Coliform |
|---|---|---|
| 0 (Control) | $10^6$ | $10^6$ |
| 9 | $10^5$ | $10^5$ |
| 22 | $10^4$ | $10^4$ |
| 44 | $10^3$ | $10^3$ |
| 66 | 0 | 0 |

We claim:

1. A method of bleaching lignocellulosic pulp which consists essentially of the steps of:

(A) contacting a diluting liquor containing a hydrogen peroxide decomposing enzyme, with an enzyme inactivator selected from the group consisting of chlorine, bromine, iodine, chlorine dioxide and ozone; and (B) diluting hydrogen peroxide bleaching liquor with said dilution liquor containing said inactivator; and (C) contacting the lignocellulosic pulp with an amount of hydrogen peroxide sufficient to bleach the pulp, wherein said inactivator is in an amount sufficient to inactivate said enzyme, but not sufficient to bleach said lignocellulosic pulp.

2. A method according to claim 1, wherein said hydrogen peroxide is present in a concentration of 0.1 to 100% based on the weight of said bleachable material and said enzyme-inactivator is added to said dilution liquor in a concentration of from 0.1 to 10 ppm based on the weight of said liquor.

3. A method of bleaching according to claim 2 wherein said contacting step (C) is affected at a pH greater than 5.

4. A method of bleaching according to claim 3 wherein said contacting step (C) is affected at a pH greater than 8.

5. A method of bleaching according to claim 4 wherein said contacting step (C) is affected at a pH greater than 10.

6. A method of bleaching according to claim 4 wherein said contacting step (C) is affected at a pH of about 11.

7. A method of bleaching according to claim 1 wherein said enzyme-inactivator is chlorine dioxide.

8. A method according to claim 7, in which an effective amount of up to 500 ppm chlorine dioxide is contacted with the liquor based on the weight of the liquor.

9. A method according to claim 8, in which an effective amount of up to 100 ppm chlorine dioxide is contacted with the liquor based on the weight of the liquor.

10. A method according to claim 9, in which an effective amount of up to 50 ppm chlorine dioxide is contacted with the liquor based on the weight of the liquor.

11. A method according to claim 10, in which an effective amount of up to 5 ppm chlorine dioxide is contacted with the liquor based on the weight of the liquor.

12. A method according to claim 11 in which the liquor contains at least 0.01 ppm chlorine dioxide based on the weight of the liquor.

13. A method according to claim 12, in which the liquor contains at least 0.5 ppm chlorine dioxide based on the weight of the liquor.

14. A method according to claim 13, in which the liquor contains at least 0.1 ppm chlorine dioxide based on the weight of the liquor.

15. A method according to claim 1, in which the bleachable material is contacted with a bleaching liquor which contains from 0.01% to 10% hydrogen peroxide by volume relative to the volume of liquor.

16. A method according to claim 15, in which the bleaching liquor contains about 0.1% hydrogen peroxide by weight relative to the total weight of solids to be bleached.

17. A method according to claim 1, in which the bleachable material is a recycled cellulose pulp.

18. A method according to claim 1, in which the bleachable material is a mechanical pulp.

19. A method according to claim 17, in which the bleachable material comprises wood, bagasse or flax.

20. A method of bleaching recycled cellulose pulp containing bleachable compounds which consists essentially of the steps of:

(a) contacting recycled cellulose pulp in a pulping and bleaching zone with alkali sufficient to provide a pH of from 8 to 12, water and an amount of hydrogen peroxide sufficient to bleach said bleachable compounds to form a bleached pulp;

(b) separating a liquor from said pulp, said separated liquor containing a hydrogen peroxide deactivating enzyme;

(c) diluting said separated liquor with at least part of said water to form a diluted liquor;

(d) adding an enzyme-inactivating amount of chlorine-dioxide to said diluted liquor, wherein said enzyme inactivating amount is sufficient to inactivate said enzyme but not sufficient to bleach said cellulose pulp; and thereafter (e) recycling said diluted liquor containing the chlorine dioxide to said pulping zone.

* * * * *